United States Patent [19]

Sakai et al.

[11] 4,338,388

[45] Jul. 6, 1982

[54] ELECTROPHOTOGRAPHIC ELEMENT WITH A PHENYHYDRAZONE CHARGE TRANSPORT LAYER

[75] Inventors: Kiyoshi Sakai; Mitsuru Hashimoto, both of Numazu; Tomiko Kawakami, Tokyo, all of Japan

[73] Assignee: Ricoh Company, Limited, Tokyo, Japan

[21] Appl. No.: 83,482

[22] Filed: Oct. 10, 1979

[30] Foreign Application Priority Data

Oct. 13, 1978 [JP] Japan ..... 53/125145

[51] Int. Cl.[3] ..... G03G 5/06; G03G 5/14

[52] U.S. Cl. ..... 430/59; 430/58; 430/79

[58] Field of Search ..... 430/56, 58, 59, 70, 430/73, 74, 76, 78, 96

[56] References Cited

U.S. PATENT DOCUMENTS

| | | | |
|---|---|---|---|
| 3,870,516 | 3/1975 | Smith et al. | 430/96 X |
| 3,915,702 | 10/1975 | Bergfjord et al. | 430/72 X |
| 4,150,987 | 4/1979 | Anderson et al. | 430/58 |
| 4,256,821 | 3/1981 | Enomoto et al. | 430/59 |
| 4,278,747 | 7/1981 | Murayama et al. | 430/82 |

FOREIGN PATENT DOCUMENTS

| | | | |
|---|---|---|---|
| 930988 | 7/1963 | United Kingdom | 430/73 |

*Primary Examiner*—John E. Kittle
*Assistant Examiner*—John L. Goodrow
*Attorney, Agent, or Firm*—Blanchard, Flynn, Thiel, Boutell & Tanis

[57] ABSTRACT

An electrophotographic element is prepared by forming a photoconductive layer containing a hydrazone compound therein on an electroconductive support member. The hydrazone compounds represented by the following general formula, are useful as photoconductive materials and as charge transport materials for use in electrophotography:

wherein Ar represents a substituted or unsubstituted condensed polycyclic group or heterocyclic group, and R represents a methyl group, an ethyl group, a benzyl group or a phenyl group. The condensed polycyclic group includes a naphthalene ring, and an anthracene ring. The heterocyclic ring includes nitrogen, oxygen and sulfur.

23 Claims, 3 Drawing Figures

ELECTROPHOTOGRAPHIC ELEMENT WITH A PHENYHYDRAZONE CHARGE TRANSPORT LAYER

BACKGROUND OF THE INVENTION

The present invention relates to an electrophotographic element and more particularly to an electrophotographic element comprising an electroconductive support member and a photoconductive layer containing a hydrazone compound represented by the following general formula (1) therein, which is formed on the electroconductive support member:

(1)

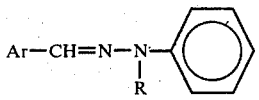

wherein Ar represents a substituted or unsubstituted condensed polycyclic group or heterocyclic group, and R represents a methyl group, an ethyl group, a benzyl group or a phenyl group. The condensed polycyclic group includes a naphthalene ring, and an anthracene ring. The heterocyclic ring includes nitrogen, oxygen or sulfur.

Conventionally, inorganic materials, such as selenium, cadmium sulfide, and zinc oxide, are used as the photoconductive materials for use in electrophotography. In the electrophotography, the surface of a photoconductor is charged, for example, by exposing the surface to corona discharge in the dark, and the photoconductor is then exposed to a light image, whereby electric charges are selectively conducted away from the exposed area on the surface of the photoconductor, resulting in that a latent electrostatic image is formed on the surface of the photoconductor. The thus formed latent electrostatic image is developed with toner comprising coloring materials, such as dyes and pigments, and polymeric binder materials. As the indispensible fundamental characteristics of a photoconductor material for use in the electrophotography, the following characteristics are required:

(1) the photoconductor can be charged to an appropriate potential in the dark; (2) electric charges are not conducted away in the dark from the surface of the photoconductor; (3) electric charges are readily conducted away from the surface of the photoconductor under illumination. The above-mentioned inorganic materials have, in fact, an excellent quality, but they still have various shortcomings at the same time.

For instance, selenium, which is now widely used, can meet the above-mentioned requirements of (1) through (3) sufficiently. However, its production is difficult and the production cost is high. More specifically, selenium is not flexible enough for use in a belt-like form and is sensitive to heat and mechanical shocks.

Cadmium sulfide and zinc oxide are respectively dispersed in a binder resin and formed into photoconductors for use in electrophotography. However, the thus prepared photoconductors are respectively poor in the surface smoothness, hardness, tensile strength and abrasion resistance. Therefore, they cannot be used in repetition for a long period of time as they are.

Recently, a variety of electrophotographic photoconductors containing various organic materials have been proposed to eliminate the above-mentioned shortcomings of the inorganic materials. As a matter of fact, some of them are practically used. For instance, the following photoconductors are used in practice: a photoconductor comprising poly-N-vinylcarbazole and 2,4,7-trinitrofluorene-9-on (U.S. Pat. No. 3,484,237); poly-N-vinylcarbazole sensitized by pyrylium salt base pigments (Japanese Patent Publication No. 48-25658); a photoconductor consisting essentially of azo pigments (U.S. Pat. No. 3,775,105); and a photoconductor consisting essentially of an eutectic co-crystalline comprising a dye and a resin (U.S. Pat. No. 3,684,502 and U.S. Pat. No. 3,732,180). These photoconductors have excellent characteristics and high practical value in fact. However, they still have their own shortcomings in view of the requirements for use in electrophotography. Furthermore, U.S. Pat. No. 3,717,462 and U.S. Pat. No. 3,765,884 disclose the use of hydrazone compounds in electrophotographic plates. In U.S. Pat. No. 4,150,987, hydrazone compounds are employed in a charge transfer layer of an electrophotographic element.

SUMMARY OF THE INVENTION

It is therefore an object of the present invention to provide an electrophotographic element, eliminating the above-mentioned shortcomings of the conventional electrophotographic photoconductors.

According to the present invention, the electrophotographic element is prepared by forming a photoconductive layer containing a hydrazone compound therein on an electroconductive support manner. The hydrazone compounds represented by the following general formula are useful as photoconductive materials and as charge transport materials for use in electrophotography:

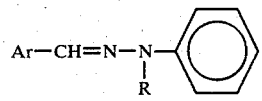

wherein Ar represents a substituted or unsubstituted condensed polycyclic group or hetrocyclic group, and R represents a methyl group, an ethyl group, a benzyl group or a phenyl group. The condensed polycyclic group includes a naphthalene ring, and an anthracene ring. The heterocyclic ring includes nitrogen, oxygen and sulfur.

DETAILED DESCRIPTION OF THE PREFERRED EMBODIMENTS

Figure 1:
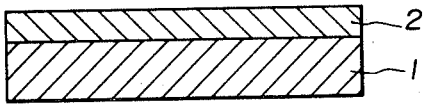
FIG. 1 is an enlarged schematic sectional view of an embodiment of an electrophotographic element according to the present invention.

The hydrazone compounds represented by the previously mentioned general formula (1) can be prepared by the following ordinary procedure of condensing equal moles of an aldehyde compound and a phenylhydrazine compound in alcohol, and, if necessary, by addition of a small amount of a condensing agent, such as glacial acetic acid or inorganic acid thereto.

The following are the specific examples of the hydrazone compounds represented by the general formula (1):

(1)

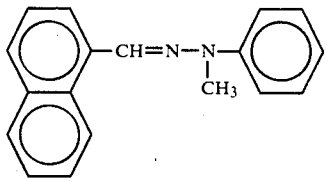

1-Naphthalenecarbaldehyde 1-methyl-1-phenylhydrazone (2)

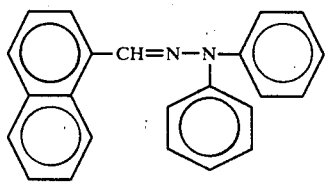

1-Naphthalenecarbaldehyde 1,1-diphenylhydrazone (3)

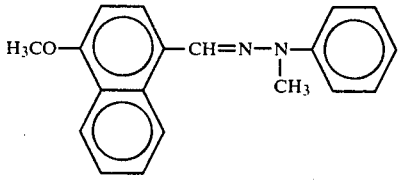

4-Methoxynaphthalene-1-carbaldehyde 1-methyl-1-phenylhydrazone (4)

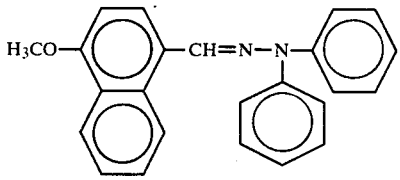

4-Methoxynaphthalene-1-carbaldehyde 1,1-diphenylhydrazone (5)

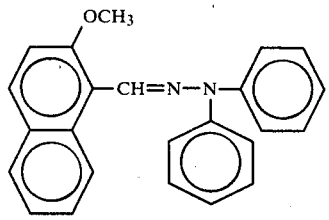

2-Methoxynaphthalene-1-carbaldehyde 1,1-diphenylhydrazone (6)

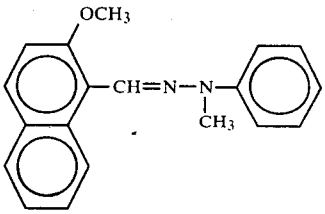

2-Methoxynaphthalene-1-carbaldehyde 1-methyl-1-phenylhydrazone (7)

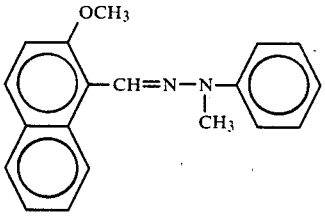

2-Methoxynaphthalene-1-carbaldehyde 1-methyl-1-phenylhydrazone (8)

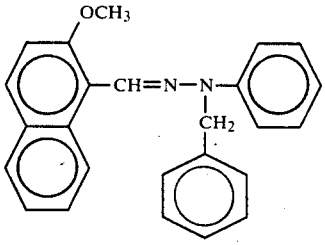

2-Methoynaphthalene-1-carbaldehyde 1-benzyl-1-phenylhydrazone (9)

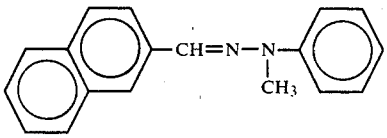

2-Naphthalenecarbaldehyde 1-methyl-1-phenylhydrazone (10)

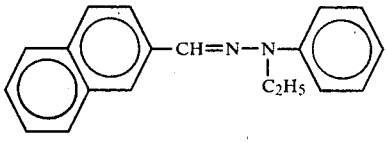

2-Naphthalenecarbaldehyde 1-ethyl-1-phenylhydrazone (11)

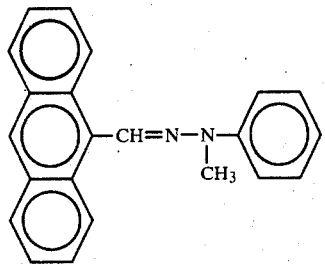

9-Anthracenecarbaldehyde 1-methyl-1-phenylhydrazone (12)

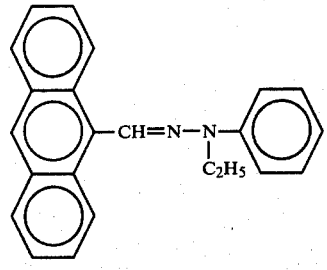

9-Anthracenecarbaldehyde 1-ethyl-1-phenylhydrazone (13)

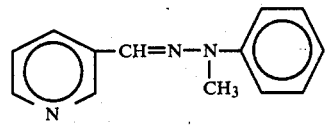

3-Pyridinecarbaldehyde 1-methyl-1-phenylhydrazone (14)

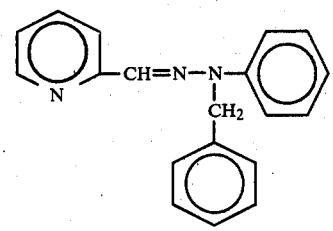

2-Pyridinecarbaldehyde 1-benzyl-1-phenylhydrazone (15)

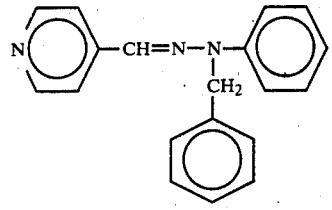

4-Pyridinecarbaldehyde 1-benzyl-1-phenylhydrazone (16)

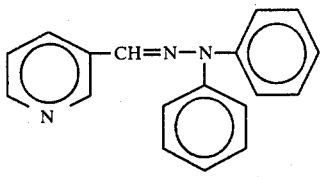

3-Pyridinecarbaldehyde 1,1-diphenylhydrazone (17)

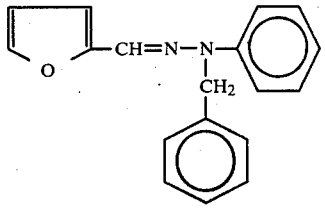

2-Furancarbaldehyde 1-benzyl-1-phenylhydrazone (18)

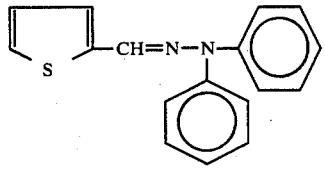

2-Thiophenecarbaldehyde 1,1-diphenylhydrazone

Figure 2:
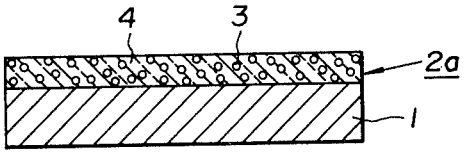
FIG. 2 is an enlarged sectional view of another embodiment of an electrophotographic element according to the present invention.
Figure 3:
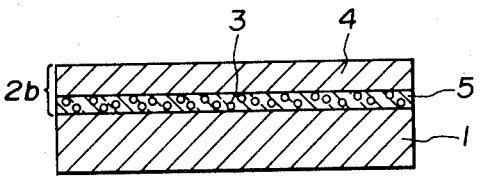
FIG. 3 is an enlarged sectional view of a further embodiment of an electrophotographic element according to the present invention.

The photoconductive materials for use in the present invention contain any of the above hydrazone compounds. By use of any of the photoconductive materials, the electrophotographic elements according to the present invention are prepared as shown in FIG. 1 through FIG. 3. Referring to FIG. 1, there is shown one embodiment of an electrophotographic element according to the present invention, in which a photoconductive layer 2 comprising a hydrazone compound, a sensitizer dye and a binder agent (resin), is formed on an electroconductive support member 1. Referring to FIG. 2, there is shown another embodiment of an electrophotographic element according to the present invention, in which, on the electroconductive support member 1, there is formed a photoconductive layer 2*a*, wherein a charge carrier producing material 3 is dispersed in a charge transport medium 4 comprising a hydrazone compound and a binder agent. Referring to FIG. 3, there is shown a further embodiment of an electrophotographic element according to the present invention, in which on the electroconductive support member 1, there is formed a photoconductive layer 2*b* comprising a charge carrier producing layer 5 consisting essentially of the charge carrier producing material 3, and the charge transport layer 4 comprising a hydrazone compound and a binder agent.

In the electrophotographic element as shown in FIG. 1, the hydrazone compound acts as a photoconductive material, and the production and movement of charge carriers necessary for light decay of the photoconductor are performed through the hydrazone compound. The hydrazone compounds, however, scarcely absorb light in the visible light range. Therefore, in order to form images by visible light, it is necessary to sensitize the hydrazone compounds by adding a sensitizer dye which absorbs visible light to the photoconductive layer 2.

In the case of the electrophotographic element as shown in FIG. 2, the hydrazone compound and a binder agent (or the combination of a binder agent and a plasticizer) constitute a charge transport medium 4, while a charge carrier producing material, such as an inorganic or organic pigment, produces charge carriers. In this electrophotographic element, the charge transport medium 4 serves to receive charge carriers mainly produced by the charge carrier producing material and to transport the charge carriers. A fundamental requirement for the electrophotographic element is that the absorption wavelength range of the charge carrier producing material and that of the hydrazone compound do not overlap each other in the visible light range. This is because it is required that light reach the surface of the charge carrier producing material in order that the charge carrier producing material produces charge carriers efficiently. A feature of the hydrazone compounds for use in the present invention is that the hydrazone compounds scarcely absorb light in the visible light range and that they serve effectively as charge transport materials when they are combined with a charge carrier producing material which generally absorbs visible light and produces charge carriers.

In the electrophotographic element as shown in FIG. 3, light passes through the charge transport layer 4 and reaches the charge carrier producing layer 5 where charge carriers are produced, while the charge transport layer 4 receives and moves the charge carriers, and the charge carriers necessary for dark decay of the electrophotographic element are produced by the charge carrier producing material and moved by the charge transport medium, in particular by the hydrazone compounds in the present invention. This mechanism is the same as that of the electrophotographic element as shown in FIG. 2. Furthermore, the hydrazone compounds serve as charge transport materials as well in this case.

The electrophotographic element as shown in FIG. 1 is prepared as follows: A hydrazone compound is dissolved a solution of a binder and if necessary, a sensitizer dye is added to the solution, and the solution is then coated on the electroconductive support member 1. The coated layer is then dried. The electrophotographic element as shown in FIG. 2 is prepared as follows: A powder-like charge carrier producing material is dispersed in a solution of a hydrazone compound and a binder agent. The thus prepared dispersion is coated on the electroconductive support member 1 and the coated layer is then dried. The electrophotographic element as shown in FIG. 3 is prepared as follows: A charge carrier producing material is evaporated in vacuum onto the electroconductive support member 1, or a powder-like charge carrier producing material is dispersed in an appropriate solvent, and if necessary, with addition of a binder agent thereto, and the dispersion is then coated on the electroconductive support member 1 and the coated layer is dried. The surface of the coated layer is finished by buffing if necessary and the thickness of the coated layer is adjusted. Thereafter, a solution of a hydrazone compound and a binder agent is applied to the above-mentioned layer and is then dried. The coated can be performed in an ordinary manner, for instance, by use of a doctor blade or a wire bar.

In the electrophotographic elements in FIG. 1 and FIG. 2, the thickness of each of the photoconductive layers 2 and 2*a* is in the range of 3 μm to 50 μm, preferably in the range of 5 μm to 20 μm. Furthermore, in the electrophotographic element in FIG. 3, the thickness of the charge carrier producing layer 5 is in the range of 0.04 μm to 5 μm, preferably in the range of 0.05 μm to 2 μm, and the thickness of the charge transport layer 4 is in the range of 3 μm to 50 μm, preferably in the range of 5 μm to 20 μm. In the photoconductor in FIG. 1, the content of a hydrazone compound in the photoconductive layer 2 is in the range of 30 wt% to 70 wt %, preferably about 50 wt% with respect to the weight of the photoconductive layer 2, and the content of a sensitizer dye for giving photosensitivity in the visible light range to the photoconductive layer 2 is in the range of 0.1 wt% to 5 wt%, preferably in the range of 0.5 wt% to 3 wt% with respect to the weight of the photoconductive layer 2. In the electrophotographic element in FIG. 2, the content of the hydrazone compound in the photoconductive layer 2*a* is in the range of 10 wt% to 95 wt%, preferably in the range of 30 wt% to 90 wt%, while the content of a charge carrier producing material is in the range of 0.1 wt% to 50 wt%, preferably in the range of 0.5 wt% to 20 wt%, with respect to the weight of the photoconductive layer 2*a*, respectively. The content of a hydrazone compound in the charge transport layer 4 of the electrophotographic element photoconductor in FIG. 3 is in the range of 10 wt% to 95 wt%, preferably in the range of 30 wt% to 90 wt% as in the case of the photoconductive layer of the electrophotographic element in FIG. 2. When preparing the electrophotographic elements in FIG. 1 through FIG. 3, a plasticizer can be used in combination with a binder agent.

As the electroconductive support member 1 for use in the present invention, the following can be employed: metal plate and foil, such as aluminum plate and aluminum foil, and plastic film with a metal, such as aluminum, evaporated thereon, and paper treated so as to be electrically conductive.

As the binder agents for use in the present invention, the following can be employed: polyacrylate, polyamide, polyurethane, polyester, epoxy resin, condensed resins, such as polyketone and polycarbonate, and vinyl polymers, such as polyvinyl ketone, polystyrene, poly-N-vinylcarbazole, and polyacrylamide, mixtures of the above-mentioned resins, and any other electrically insulating and adhesive resins.

As the plasticizers for use in the present invention, the following can be employed: halogenated paraffin, polybiphenyl chloride, dimethylnaphthalene and dibutyl phthalate.

As the sensitizers for use in the photoconductive layer 2 of the electrophotographic element in FIG. 1, the following can be employed: triarylmethane dye, such as Brilliant Green, Victoria Blue B, Methyl Violet, Crystal Violet and Acid Violet 6B, and xanthene dye, such as Rhodamine B, Rhodamine 6G, Rhodamine G Extra, Eosine S, erythrosine, Rose Bengale and Fluoresceine, and thiazine dye, such as Methylene Blue, and cyanine dye, such as cyanin, and pyrylium dye, such as 2,6-diphenyl-4-(N,N-dimethylaminophenyl) thiapyrylium-perchlorate and benzopyrylium salt.

As the charge carrier producing materials for use in the photoconductors as shown in FIG. 2 and FIG. 3, the following can be employed:

1. Inorganic pigments, such as selenium, selenium-tellurium, selenium-tellurium-halogen, selenium-arsenic, cadmium sulfide and cadmium sulfide-selenium.

2. Organic pigments, such as C. I. Pigment Blue-25 (Color Index C. I. 21180), C. I. Pigment Red 41 (C. I. 21200), C. I. Acid Red 52 (C. I. 45100) and C. I. Basic Red 3 (C. I. 45210)

3. Azo pigments having a carbazole group as represented by the general formula:

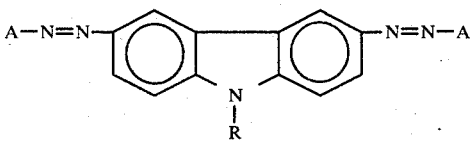

(U.S. patent application Ser. No. 872,679 and Corresponding Japanese Patent Application No. 52-8740)

4. Azo pigments having a styrylstilbene group as represented by the general formula:

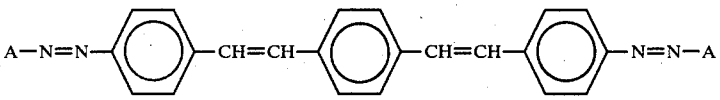

(U.S. patent application Ser. No. 898,130 and corresponding Japanese Patent Application No. 52-48859)

5. Azo pigments having a triphenylamine group as represented by the general formula:

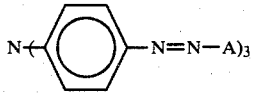

(U.S. patent application Ser. No. 897,508 and Corresponding Japanese Patent Application No. 52-45812)

6. Azo pigments having a dibenzothiophene group as represented by the general formula:

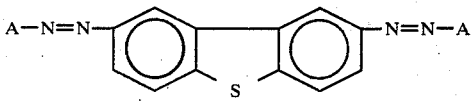

(U.S. patent application Ser. No. 925,157 and Corresponding Japanese Patent Application No. 52-86255)

7. Azo pigments having an oxadiazole group as represented by the general formula

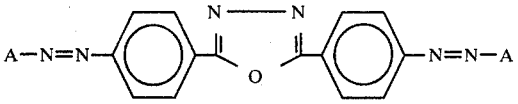

(U.S. patent application Ser. No. 908,116 and Corresponding Japanese Patent Application No. 52-77155)

8. Azo pigments having a fluorenone group as represented by the general formula:

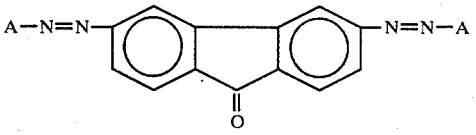

(U.S. patent application Ser. No. 925,157 and Corresponding Japanese Patent Application No. 52-87351)

9. Azo pigments having bis-stilbene groups as represented by the general formula:

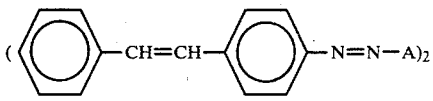

(U.S. patent application Ser. No. 922,526 and Corresponding Japanese Patent Application No. 52-81790)

10. Azo pigments having distyryloxadiazole group as represented by the general formula:

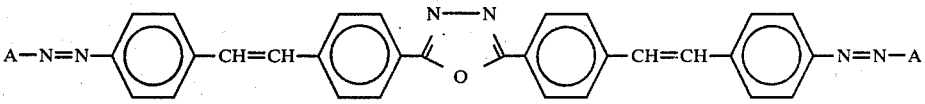

(U.S. patent application Ser. No. 908,116 and Corresponding Japanese Patent Application No. 52-66711)

11. Azo pigments having a distyrylcarbazole group as represented by the general formula:

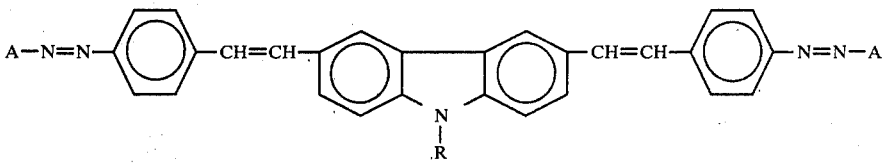

(U.S. patent application Ser. No. 921,086 and Corresponding Japanese Patent Application No. 52-81791)

12. Phthalocyanine pigments, such as C. I. Pigment Blue 16 (C. I. 74100)

13. Indigo pigments, such as C. I. Vat Brown 5 (C. I. 73410) and C. I. Vat Dye (C. I. 73030)

14. Perylene pigments, such as A190 Scarlet B (commercially available from Bayer A. G.) and Indanthren Scarlet R (commercially available from Bayer A. G.).

In the thus obtained electrophotographic elements, if necessary, an adhesive layer or a barrier layer can be disposed between the electroconductive support member 1 and the photoconductive layer 2, 2*a* or 2*b*. Polyamide, nitrocellulose, or aluminum oxide is used in the adhesive layer or the barrier layer, and it is preferable that the thickness of the adhesive layer or the barrier layer be not more than 1 μm.

When copying is made by use of any of the electrophotographic elements according to the present invention, the surface of the photoconductor is charged and is then exposed to a light image to form a latent electrostatic image. The thus formed latent electrostatic image is developed with toner, and if necessary, the developed toner image is transferred to paper. The electrophotographic elements according to the present invention have a high photosensitivity and are very flexible. Thus, the electrophotographic elements according to the present invention can be employed in the so-called Carlson Process and further, in such copying process as are disclosed in U.S. Pat. No. 3,655,369 issued to Kinoshita, U.S. Pat. No. 4,071,361 issued to Marushima, U.S. Pat. No. 3,893,310 issued to Bean and U.S. Pat. No. 3,776,627 issued to Ohnishi et al.

EXAMPLE 1

To two parts by weight of Diane Blue (C. I. Pigment Blue 25 CI 21180) were added 98 parts by weight of tetrahydrofuran. The mixture of Diane Blue and tetrahydrofuran was ground in a ball mill so that a charge carrier producing pigment dispersion was prepared. This dispersion was coated on an aluminum evaporated polyester film by a doctor blade and was then air-dried at room temperature, so that a 1 μm thick charge carrier producing layer was formed on the aluminum evaporated polyester film.

Two parts by weight of 1-naphthalenecarbaldehyde 1-methyl-1-phenylhydrazone which is represented by the formula (1),

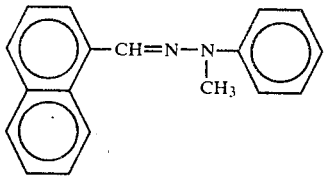

(1)

3 parts by weight of polycarbonate (Panlite L commercially available from Teijin Co., Ltd.) and 45 parts of tetrahydrofuran were mixed so that a charge transport layer formation liquid was prepared. The thus prepared charge transport layer formation liquid was coated on the charge carrier producing layer by a doctor blade and was then dried at 100° C. for 10 minutes so that an approximately 10 μm thick charge transport layer was formed on the charge carrier producing layer. Thus, an electrophotographic element No. 1 according to the present invention was prepared.

The electrophotographic element was charged negatively in the dark under application of −6 kV of corona charge for 20 seconds and was then allowed to stand in the dark for 20 seconds without applying any charge thereto. At this moment, the surface potential Vpo (V) of the electrophotographic element was measured by Paper Analyzer (Kawaguchi Electro Works, Model SP-428). The electrophotographic element was then illuminated by a tungsten lamp in such a manner that the illuminance on the illuminated surface of the electrophotographic element was 20 lux, so that the exposure $E_{\frac{1}{2}}$(lux. second) required to reduce the initial surface potential Vpo (V) to $\frac{1}{2}$ the initial surface potential Vpo (V) was obtained. The results showed that Vpo = −980 V and $E_{\frac{1}{2}}$ = 8.6 lux. second.

EXAMPLE 2

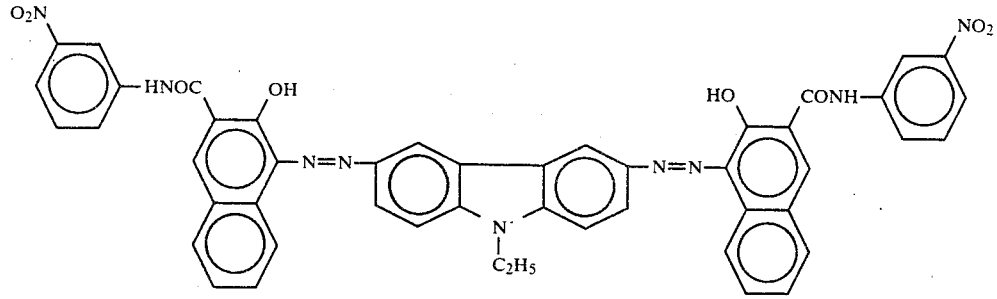

| | |
|---|---|
| Charge carrier producing pigment | 3 parts by weight |
| Polyester resin (Polyester Adhesive 49000 commercially Available from Dupont) | 1 part by weight |
| Tetrahydrofuran | 96 parts by weight |

A mixture of the above-mentioned components was ground in a ball mill so that a charge carrier producing pigment dispersion was prepared. This dispersion was coated on an aluminum evaporated polyester film by a doctor blade and was then dried at 80° C. in a drier for 5 minutes, so that a 1 μm thick charge carrier producing layer was formed on the aluminum evaporated polyester film.

Then, two parts by weight of 2-naphthalenecarbaldehyde 1-ethyl-1-phenylhydrazone, which is represented by the formula (10)

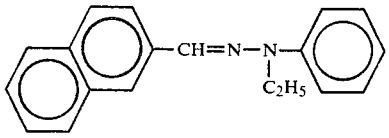

(10)

3 parts by weight of polycarbonate (Panlite L commercially available from Teijin Co., Ltd.) and 45 parts by weight of tetrahydrofuran were mixed so that a charge transport layer formation liquid was prepared.

The thus prepared charge transport layer liquid was coated on the charge carrier producing layer by a doctor blade and was then dried at 100° C. for 10 minutes so that a 10 μm thick charge transport layer was formed on the charge carrier producing layer. Thus, electrophotographic element No. 2 according to the present invention was prepared.

As in the case of Example 1, the electrophotographic element was charged negatively in the dark under application of −6 kV of corona charge for 20 seconds, and was then allowed to stand in the dark for 20 seconds without applying any charge thereto, and as in the case of Example 1, Vpo and $E_{\frac{1}{2}}$ were measured. The results showed that Vpo = −900 V and $E_{\frac{1}{2}}$ = 4.2 lux. second.

EXAMPLE 3

In Example 2,

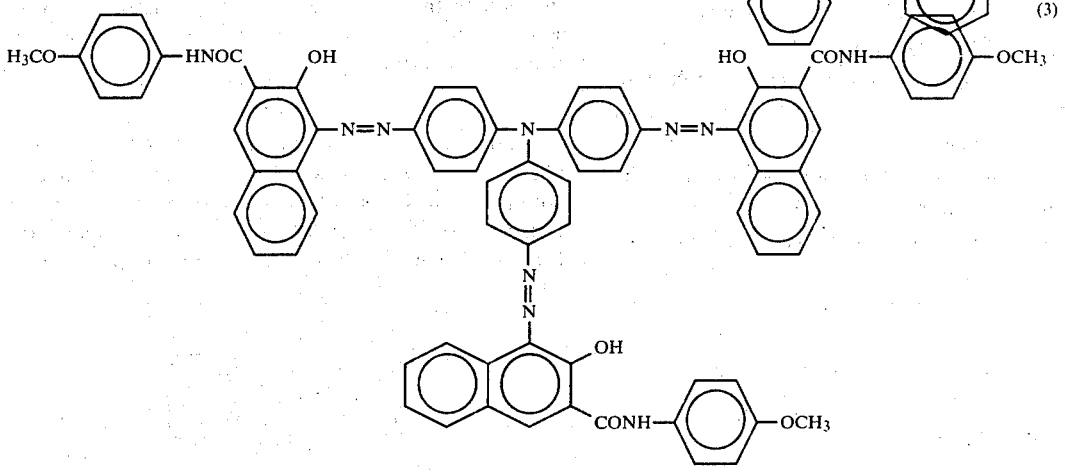

was employed as the charge carrier producing pigment, and 2-pyridinecarbaldehyde 1-benzyl-1-phenylhydrazone represented by the formula (14)

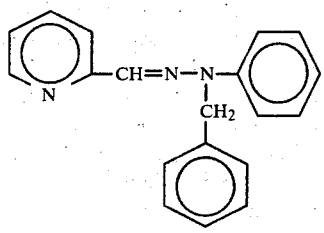

(14)

was employed as the charge transport material. Under the same condition as that in Example 2, a 1.0 μm thick charge carrier producing layer was formed on an aluminum evaporated polyester film, and a 12 μm thick charge transport layer was formed on the charge carrier producing layer. Thus, an electrophotographic element No. 3 was prepared, and Vpo and $E_{\frac{1}{2}}$ were measured likewise. The results showed that Vpo = −820 V and $E_{\frac{1}{2}}$ = 4.2 lux. second.

EXAMPLE 4

In Example 2, 1,4-bis[4-{2-hydroxy-3-(2,4-dimethylphenyl)carbamoylnaphthyl-1}azostyryl-1]benzene represented by the following formula

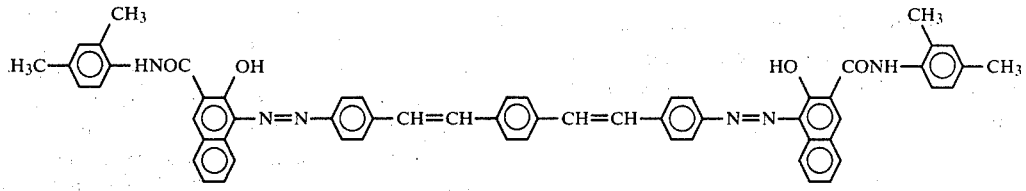

(4)

was employed as the charge carrier producing pigment, and 4-methoxynaphthalene-1-carbaldehyde 1,1-diphenylhydrazone represented by formula (4)

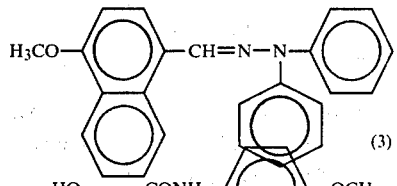

(4)

(3)

was employed as the charge transport material. Under the same condition as that in Example 2, a 1.0 μm thick charge carrier producing layer was formed on an aluminum evaporated polyester film, and a 12 μm thick charge transport layer was formed on the charge carrier producing layer. Thus, an electrophotographic element No. 4 was prepared, and Vpo and $E_{\frac{1}{2}}$ were measured likewise. The results showed that Vpo = −880 V and $E_{\frac{1}{2}}$ = 2.1 lux. second.

Each of the electrophotographic elements prepared in Examples 1 to 4 was negatively charged by a commercially available copying machine and a latent image was formed on each electrophotographic element and was developed with a positively charged dry type toner. The thus developed toner image was transferred electrostatically to a high quality transfer sheet and was fixed to the transfer sheet. As a result, a clear toner image was obtained from each electrophotographic element. In the case where a wet type developer was used instead of the dry type toner, a clear image was also obtained from each electrophotographic element.

EXAMPLE 5

A 1 μm thick charge carrier producing layer consisting of selenium was formed on an approximately 300 μm thick aluminum plate by vacuum evaporation. Then, two parts by weight of 2-methoxynaphthalene-1-carbaldehyde 1,1-diphenylhydrazone represented by the formula (5)

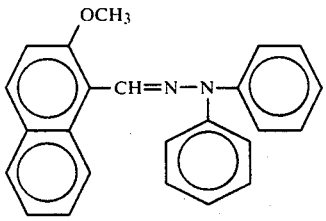

(5)

3 parts by weight of polyester resin (Polyester Adhesive 49000 commercially available from Dupont) and 45 parts by weight of tetrahydrofuran were mixed so that a charge transport layer formation liquid was prepared. The thus prepared charge transport formation liquid was coated on the charge carrier producing layer consisting of selenium by a doctor blade and was then air-dried at room temperature, and was further dried under reduced pressure so that a 10 μm thick charge transport layer was formed on the charge carrier producing layer. Thus, an electrophotographic element No. 5 according to the present invention was prepared. By the same procedure as in the case of Example 1, Vpo and $E_{\frac{1}{2}}$ were measured. The results showed that Vpo = −905 V and $E_{\frac{1}{2}}$ = 6.2 lux. second.

EXAMPLE 6

In Example 5, instead of selenium, a perylene pigment C. I. Vat Red 23 (C. I. 71130) represented by the formula

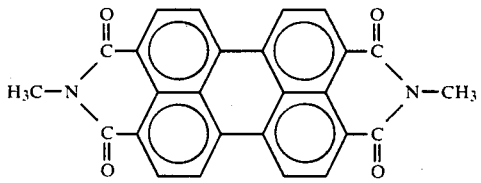

was vacuum-evaporated with the thickness of 0.3 μm on an approximately 300 μm thick aluminum plate so that a charge carrier producing layer was formed. As the charge transport material, 2-naphthalenecarbaldehyde 1-methyl-1-phenylhydrazone represented by the formula (9) was employed so that a 12 μm thick charge transport layer was formed.

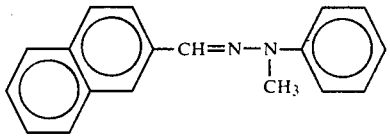

(9)

Under the same condition as that in Example 5, except the above-mentioned charge carrier producing layer and charge transport layer, an electrophotographic element No. 6 according to the present invention was prepared. By the same procedure as in the case of Example 1, Vpo and $E_{\frac{1}{2}}$ were measured. The results showed that Vpo = −1180 V and $E_{\frac{1}{2}}$ = 6.0 lux second.

Each of the electrophotographic elements prepared in Examples 5 to 6 was negatively charged by a commercially available copying machine and a latent image was formed on each electrophotographic element and was developed with a positively charged dry type toner. The thus developed toner image was transferred electrostatically to a high quality transfer sheet and was fixed to the transfer sheet. As a result, a clear toner image was obtained from each electrophotographic element. In the case where a wet type developer was used instead of the dry type toner, a clear image was also obtained from each electrophotographic element.

EXAMPLE 7

A mixture of one part by weight of Chloro Diane Blue and 158 parts by weight of tetrahydrofuran was ground and mixed in a ball mill. To the mixture were added 12 parts by weight of 1-naphthalenecarbaldehyde 1-methyl-1-phenylhydrazone represented by the formula (1)

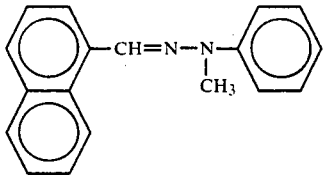

(1)

and 18 parts by weight of polyester resin (Polyester Adhesive 49000 commercially available from Dupont). The mixture was further mixed so that a photoconductive layer formation liquid was prepared. The thus prepared photoconductor layer formation liquid was coated on an aluminum evaporated polyester film by a doctor blade and was then dried at 100° C. for 30 minutes so that a 16 μm thick photoconductive layer was formed on the aluminum evaporated polyester film. Thus, an electrophotographic element No. 7 according to the present invention was prepared. The electrophotographic element was positively charged under application of +6 kV of corona charge. Under the same conditions and by use of the same paper analyzer as in Example 1, Vpo and $E_{\frac{1}{2}}$ were measured. The results showed that Vpo = 940 V and $E_{\frac{1}{2}}$ = 5.8 lux. second.

EXAMPLE 8

In Example 7, instead of Chloro Diane Blue,

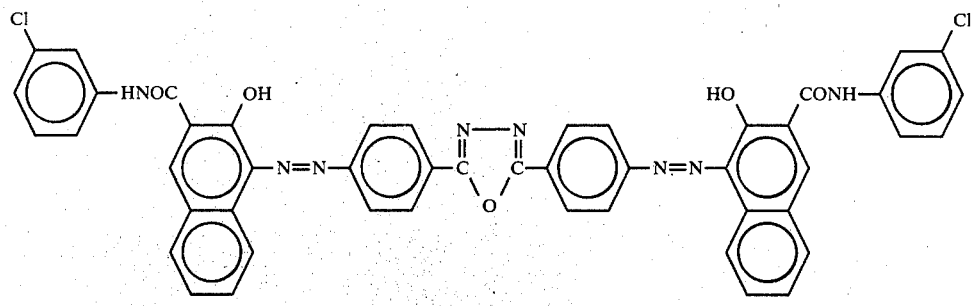

(8)

was employed as the charge carrier producing pigment, and 1-naphthalenecarbaldehyde 1-methyl-1-phenylhydrazone represented by the formula (1) was employed as the charge transport material.

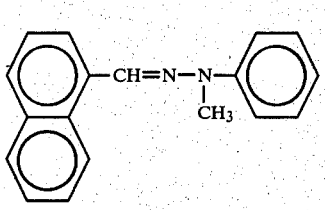

(1)

Under the same condition as that in Example 7, a 15 μm thick photoconductive layer was formed on an aluminum evaporated polyester film, so that an electrophotographic element No. 8 according to the present invention was prepared. By the same procedure as in the case of Example 1, Vpo and $E_{\frac{1}{2}}$ were measured. The results showed that Vpo=960 V and $E_{\frac{1}{2}}$=5.2 lux. second.

EXAMPLE 9

In Example 7, instead of Chloro Diane Blue and 1-naphthalenecarbaldehyde 1-methyl-1-phenylhydrazone represented by the formula (1), was employed as the charge carrier producing pigment, and 4-methoxynaphthalene-1-carbaldehyde 1,1-diphenylhydrazone represented by the formula (4) was employed as the charge transport material.

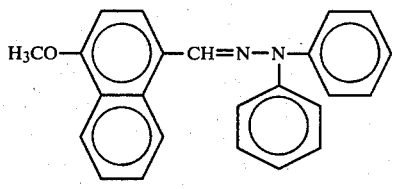

(4)

Under the same condition as that in Example 7, a 15 μm thick photoconductive layer was formed on an aluminum evaporated polyester film, so that an electrophotographic element No. 9 according to the present invention was prepared. By the same procedure as in the case of Example 1, Vpo and $E_{\frac{1}{2}}$ were measured. The results showed that Vpo=920 V and $E_{\frac{1}{2}}$=9.8 lux. second.

EXAMPLE 10

In Example 7, instead of Chloro Diane Blue and 1-naphthalenecarbaldehyde 1-1-methyl-1-phenylhydrazone represented by the formula (1),

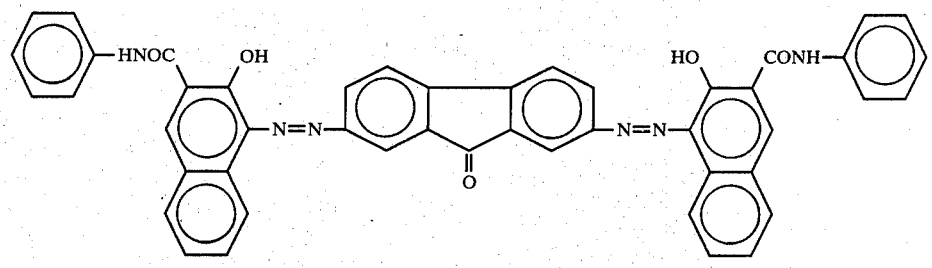

(9)

(10)

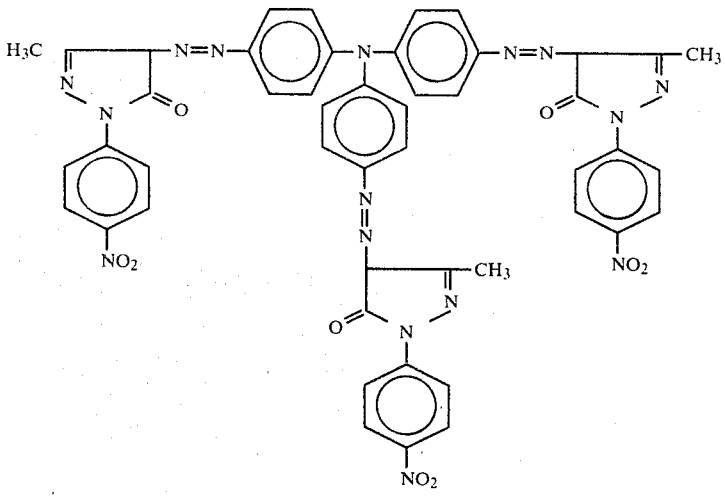

was employed as the charge carrier producing pigment, and 4-pyridinecarbaldehyde 1-benzyl-1-phenylhydrazone represented by the formula (15) was employed as the charge transport material.

(15)

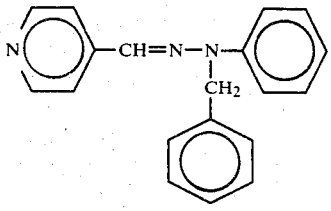

Under the same condition as that in Example 7, a 12 μm thick photoconductive layer was formed on an aluminum evaporated polyester film so that an electrophotographic element No. 10 according to the present invention was prepared. By the same procedure as in the case of Example 1, Vpo and $E_{\frac{1}{2}}$ were measured. The results showed that Vpo=820 V and $E_{\frac{1}{2}}$=8.6 lux. second.

Each of the electrophotographic elements prepared in Examples 7 to 10 was positively charged by a commercially available copying machine and a latent image was formed on each element and was developed with a negatively charged dry type toner. The thus developed toner image was transferred electrostatically to a high quality transfer sheet and was fixed to the transfer sheet. As a result, a clear toner image was obtained from each electrophotographic element. In the case where a wet type developer was used instead of the dry type toner, a clear image was also obtained from each electrophotographic element.

EXAMPLE 11

One part by weight of 4-methoxynaphthalene-1-carbaldehyde 1-methyl-1-phenylhydrazone which is represented by the formula (3), (3)

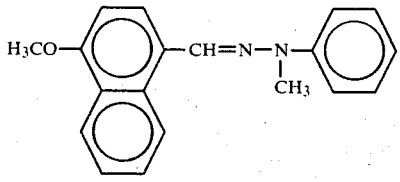

one part by weight of polycarbonate (Panlite L commercially available from Teijin Co., Ltd.) and 0.001 part by weight Crystal Violet were dissolved in 9 parts by weight of 1,2-dichloroethane. The thus prepared photoconductive layer formation liquid was coated on a paper, whose surface was treated so as to be electroconductive, by a wire bar and was then dried at 100° C. for 5 minutes so that an approximately 6 μm thick photoconductive layer was formed on the paper. Thus, an electrophotographic element No. 11 according to the present invention was prepared.

The electrophotographic element No. 11 was charged positively to approximately 500 volt by corona charger and was then exposed to a light image with 200 lux for 0.5 second, to form a latent electrostatic image on the electrophotographic element. The thus formed latent electrostatic image was developed by a wet type developer and an image faithful to the original image was obtained.

What is claimed is:

1. An electrophotographic element comprising:

an electroconductive support member, a charge carrier producing layer, a charge transport layer adjacent the charge carrier producing layer, the charge transport layer comprising a hydrazone of the formula;

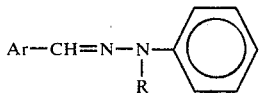

wherein Ar represents a substituted or unsubstituted fused polycyclic hydrocarbon ring system, and R represents a methyl group, an ethyl group, a benzyl group or a phenyl group; and a binder agent.

2. An electrophotographic element as claimed in claim 1, wherein said charge transport layer comprises a hydrazone selected from the group consisting of:

1-naphthalenecarbaldehyde 1-methyl-1-phenylhydrazone;

1-naphthalenecarbaldehyde 1,1-diphenylhydrazone;

4-methoxynaphthalene-1-carbaldehyde 1-methyl-1-phenylhydrazone;

4-methoxynaphthalene-1-carbaldehyde 1,1-diphenylhydrazone;

2-methoxynaphthalene-1-carbaldehyde 1,1-diphenylhydrazone;

2-methoxynaphthalene-1-carbaldehyde 1-methyl-1-phenylhydrazone;

2-methoxynaphthalene-1-carbaldehyde 1-methyl-1-phenylhydrazone;

2-methoxynaphthalene-1-carbaldehyde 1-benzyl-1-phenylhydrazone;

2-naphthalenecarbaldehyde 1-methyl-1-phenylhydrazone;

2-naphthalenecarbaldehyde 1-ethyl-1-phenylhydrazone;

9-anthracenecarbaldehyde 1-methyl-1-phenylhydrazone; and 9-anthracenecarbaldehyde 1-ethyl-1-phenylhydrazone.

3. An electrophotographic element as claimed in claim 1, wherein said charge transport layer includes 4-methoxynaphthalene-1-carbaldehyde 1-methyl-1-phenylhydrazone.

4. An electrophotographic element as claimed in claim 1, wherein said charge carrier producing layer is positioned between said electroconductive support member and said charge transport layer, with said charge transport layer forming an exposed surface of said electrophotographic element.

5. An electrophotographic element as claimed in claim 1, wherein said charge carrier producing layer is of a thickness between 0.04 μm to 5 μm, and said charge transport layer is of a thickness between 3 μm to 50 μm.

6. An electrophotographic element as claimed in claim 1 in which said charge carrier producing layer includes a photoconductive material selected from the group consisting of selenium and its alloys, azo pigment, and perylene pigment.

7. An electrophotographic element as claimed in claim 1 in which said binder agent is selected from the group consisting of polyamide, polyurethane, polyester, epoxy resin, polyketone, polycarbonate, polyvinyl ketone, polystyrene, poly-N-vinylcarbazole, polyacrylamide, polyacrylate and mixtures thereof.

8. An electrophotographic element as claimed in claim 5, wherein said charge transport layer is between 5 μm to 20 μm thick.

9. An electrophotographic element as claimed in claim 6 in which said photoconductive material is a material selected from the group consisting of azo pigments having a carbazole group, azo pigments having a styrylstilbene group, azo pigments having a triphenylamine group, azo pigments having a dibenzothiophene group, azo pigments having an oxadiazole group, azo pigments having a fluorenone group, azo pigments having a bis-stilbene group, azo pigments having a distyrylphenyloxadiazole group and azo pigments having a distyrylcarbazole group.

10. An electrophotograhic element as claimed in claim 8, wherein said photoconductive material is a material selected from the group consisting of azo pigments having a styrylstilbene group.

11. An electrophotographic element as claimed in claim 8, wherein said photoconductive material is 1,4-bis[4-{2-hydroxy-3-(2,4-dimethylphenyl)carbamoylnaphthyl-1{azostyryl-1]benzene.

12. An electrophotographic element comprising:

an electroconductive support member;

a charge carrier producing layer, which includes a photoconductive material selected from the group consisting of azo pigments having a carbazole group, azo pigments having a styrylstilbene group, azo pigments having a triphenylamine group, azo pigments having a dibenzothiophene group, azo pigments having an oxadiazole group, azo pigments having a fluorenone group, azo pigments having a bis-stilbene group, azo pigments having a distyryl-phenyloxadiazole group and azo pigments having a distyrylcarbazole group; and a charge transport layer, which comprises a hydrazone of the formula;

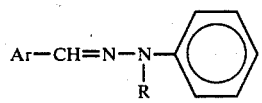

wherein Ar represents a substituted or unsubstituted fused polycyclic hydrocarbon ring system, and R represents a methyl group, an ethyl group, a benzyl group or a phenyl group; and a binder agent.

13. In an electrophotographic element comprising a photoconductive layer and an electroconductive support member for supporting said photoconductive layer thereon, the improvement wherein said photoconductive layer contains a binder agent and at least a compound selected from the group consisting of hydrazone compounds represented by the general formula

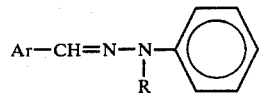

where Ar represents a substituted or unsubstituted fused polycyclic hydrocarbon ring system, and R represents a methyl group, an ethyl group, a benzyl group or a phenyl group and the thickness of said photoconductive layer is in the range of 3 μm to 50 μm and the content of said hydrazone compound is in the range of 30 to 70 wt% in said photoconductive layer.

14. An electrophotographic element as claimed in claim 13, wherein said photoconductive layer further comprises a sensitizer pigment capable of providing said photoconductive layer with a photosensitivity in the visible light range, and the content of said sensitizer pigment is in the range of 0.1 to 5 weight percent in said photoconductive layer and said sensitizer is a compound selected from the group consisting of triarylmethane dye, xanthene dye, cyanine dye, and pyrylium dye.

15. An electrophotographic element as claimed in claim 13, further comprising an adhesive layer or a barrier layer between said electroconductive layer and said photoconductive layer.

16. An electrophotographic element as claimed in claim 13, wherein said photoconductive layer further comprises a plasticizer containing a material selected from the group consisting of halogenated paraffin, polybiphenyl chloride, dimethylnaphthalene and dibutyl phthalate.

17. In an electrophotographic element comprising a photoconductive layer and an electroconductive support member for supporting said photoconductive layer thereon, the improvement wherein said photoconductive layer comprises:

a charge transport medium comprising a binder agent and a compound selected from the group consisting of hydrazone compounds represented by the general formula

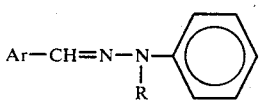

wherein Ar represents a substituted or unsubstituted fused polycyclic hydrocarbon ring system, and R represents a methyl group, an ethyl group, a benzyl group or a phenyl group;

and a charge carrier producing material dispersed in said charge transport medium, and the thickness of said photoconductive layer is in the range of 3 μm to 50 μm and the content of said hydrazone compound is in the range of 10 to 95 weight percent in said photoconductive layer, and the content of said charge carrier producing material is in the range of 0.1 to 50 weight percent in said photoconductive layer.

18. An electrophotographic element as claimed in claim 1 in which Ar is selected from the group consisting of naphthalene, methoxynaphthalene anthracene.

19. An electrophotographic element as claimed in claim 5 in which said charge transport layer is free of sensitizer for said hydrazone so that said hydrazone scarcely absorbs light in the visible light range.

20. An electrophotographic element as claimed in claim 12 in which Ar is selected from the group consisting of naphthalene, methoxynaphthalene and anthracene.

21. An electrophotographic element as claimed in claim 13 in which Ar is selected from the group consisting of naphthalene, methoxynaphthalene and anthracene.

22. An electrophotograhic element as claimed in claim 17 in which Ar is selected from the group consisting of naphthalene, methoxynaphthalene and anthracene.

23. An electrophotographic element as claimed in claim 17 in which said charge transport layer is free of sensitizer for said hydrazone so that said hydrazone scarcely absorbs light in the visible light range.

* * * * *